US007812793B2

(12) United States Patent
Steer

(10) Patent No.: US 7,812,793 B2
(45) Date of Patent: Oct. 12, 2010

(54) ACTIVE MATRIX ORGANIC ELECTROLUMINESCENT DISPLAY DEVICE

(75) Inventor: William A. Steer, Stanmore (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1035 days.

(21) Appl. No.: 10/531,605

(22) PCT Filed: Oct. 8, 2003

(86) PCT No.: PCT/IB03/04428

§ 371 (c)(1),
(2), (4) Date: Apr. 14, 2005

(87) PCT Pub. No.: WO2004/036536

PCT Pub. Date: Apr. 29, 2004

(65) Prior Publication Data

US 2006/0043371 A1 Mar. 2, 2006

(30) Foreign Application Priority Data

Oct. 18, 2002 (GB) ..... 0224277.4

(51) Int. Cl.
*G09G 3/30* (2006.01)

(52) U.S. Cl. ..... 345/76; 345/77

(58) Field of Classification Search ..... 345/76, 345/77

See application file for complete search history.

(56) References Cited

U.S. PATENT DOCUMENTS 5,170,155 A 12/1992 Plus et al.
5,302,966 A * 4/1994 Stewart ..... 345/76
5,818,389 A 10/1998 Lazar
6,188,375 B1 * 2/2001 Kagey ..... 345/76
6,337,628 B2 1/2002 Campana, Jr.
6,809,710 B2 * 10/2004 Prache et al. ..... 345/82
6,876,345 B2 * 4/2005 Akimoto et al. ..... 345/76

(Continued)

FOREIGN PATENT DOCUMENTS

EP 0455943 A2 5/1991

(Continued)

OTHER PUBLICATIONS

A. Yumoto et al. "Pixel-Driving Methods for Large-Sized Poly-Si AM-OLED Displays", Asia Display/IDW'01, Proceedings of the 21st International Display Research Conference in Conjunction With the 8th International Display Workshops, Nagoya, Japan, Oct. 16-19, 2001, vol. CONF. 21/8, Oct. 16, 2001, pp. 1395-1398.*

*Primary Examiner*—Amare Mengistu
*Assistant Examiner*—Robert R Rainey

(57) ABSTRACT

An active matrix electroluminescent display device uses a stepped voltage waveform to the input of the pixel, the stepped voltage waveform being voltage-shifted by a previously stored pixel drive voltage before application to the gate of a drive transistor. The level of the voltage shift determines the duty cycle with which the display element is driven, and thereby controls the grey level output. The height of the steps in the stepped voltage waveform is greater than the voltage width of linear operating region of the drive transistor, so that a selected step of the stepped waveform defines a transition from the drive transistor between fully on and fully off. In this way, the drive transistor is never driven in the linear region.

18 Claims, 5 Drawing Sheets

U.S. PATENT DOCUMENTS

| | | | | |
|---|---|---|---|---|
| 2001/0045929 | A1 | 11/2001 | Prache et al. | |
| 2002/0044085 | A1 | 4/2002 | Howell et al. | |
| 2002/0047817 | A1 | 4/2002 | Tam | |
| 2002/0140659 | A1 | 10/2002 | Mikami et al. | |
| 2003/0016190 | A1 * | 1/2003 | Kondo | 345/55 |

FOREIGN PATENT DOCUMENTS

| | | | |
|---|---|---|---|
| EP | 0587954 | A1 | 3/1994 |
| EP | 0717446 | A2 | 6/1996 |
| EP | 0717446 | A3 | 6/1999 |
| EP | 0973148 | A1 | 1/2000 |
| EP | 1005013 | A1 | 5/2000 |
| WO | WO9636959 | A2 | 11/1996 |
| WO | WO9636959 | A3 | 11/1996 |
| WO | 0154107 | A1 | 7/2001 |
| WO | WO 01/54107 | | 7/2001 |
| WO | 02075709 | A1 | 9/2002 |

* cited by examiner

ACTIVE MATRIX ORGANIC ELECTROLUMINESCENT DISPLAY DEVICE

This invention relates to electroluminescent display devices, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-driven display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

FIG. 2 shows in simplified schematic form a known pixel and drive circuitry arrangement for providing voltage-programmed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended. The drive transistor 22 draws a current from the power supply line 26.

The drive transistor 22 in this circuit is implemented as a PMOS TFT, so that the storage capacitor 24 holds the gate-source voltage fixed. This results in a fixed source-drain current through the transistor, which therefore provides the desired current source operation of the pixel.

The above basic pixel circuit is a voltage-programmed pixel, and there are also current-programmed pixels which sample a drive current. However, all pixel configurations require current to be supplied to each pixel.

One problem with voltage-programmed pixels, particularly using polysilicon thin film transistors, is that different transistor characteristics across the substrate (particularly the threshold voltage) give rise to different relationships between the gate voltage and the source-drain current, and artifacts in the displayed image result. Particularly at low brightness levels, these displays suffer non-uniformity.

Digital drive schemes have also been proposed. In such schemes, the LED device is effectively driven to two possible voltage levels. This overcomes the non-uniformity problem, as the pixels are no longer driven to intermediate low brightness levels. This also reduces the power consumption in the pixel circuit, because a transistor is no longer required to operate in the linear region as a current source. Instead, all transistors can be fully on or fully off, which reduces power consumption. Such a drive scheme is less sensitive to transistor characteristic variations for the same reason. This approach only gives two possible pixel outputs. However, grey scale pixel outputs can be achieved by a number of methods.

In one approach, pixels can be grouped to form larger pixels. Pixels within the group can be addressed independently, so that a grey scale is produced which is a function of the number of pixels within the group activated. This is known as an area ratio method. A drawback of this approach is the reduced resolution of the display and the increased pixel complexity.

In an alternative approach, pixels can be turned on and off more quickly than the frame rate, so that a grey scale is implemented as function of the duty cycle with which the pixel is turned on. This is known as a time ratio method. For example, a frame period may be divided into subframe periods in the ratio 1:2:4 (giving 8 evenly spaced grey scale values—i.e. 3 bit resolution). This increases the required driving capability (or else requires a reduction in the frame rate), and therefore increases the cost of the display. Typically, an n-bit grey scale resolution requires n sub-frames.

The high refresh rate tends to increase the overall display power consumption, and complicated programming sequences can be required.

WO 01/54107 discloses a pixel arrangement and drive scheme for an organic LED display, in which a ramp voltage is applied to the pixel drive transistor. The ramp voltage is shifted in dependence on an input drive level, and the drive transistor switches when the shifted ramp voltage crosses the threshold voltage of the drive transistor.

According to the invention, there is provided an active matrix electroluminescent display device comprising an array of display pixels, each pixel comprising:

an electroluminescent (EL) display element;

a drive transistor for driving a current through the display element, a drive voltage being provided to the gate of the drive transistor; and a storage capacitor for storing a drive level and connected between an input to the pixel and the gate of the drive transistor, wherein driver circuitry is provided for providing a stepped voltage waveform to the input of the pixel, the stepped voltage waveform being voltage-shifted by the storage capacitor before application to the gate of the drive transistor, and wherein the height of the steps in the stepped voltage waveform is greater than the voltage width of linear operating region of the drive transistor.

In this arrangement, a stepped signal is provided to the gate of the drive transistor so that one of the steps provides a transition between an on and off state of the drive transistor. The drive voltage dictates when this transition takes place, so that the drive voltage provides a pulse width modulation drive scheme for the drive transistor. By ensuring the height of the steps in the stepped voltage waveform is greater than the range of gate-source voltages in the linear operating region of the drive transistor, it can be ensured that a selected step of the stepped waveform defines a transition for the drive transistor between being fully on and fully off (in either order). In this way, the drive transistor is never driven in the linear region, thereby reducing power consumption.

The height of the steps in the stepped voltage waveform is preferably sufficient to include the linear operating region voltages of the drive transistors of all pixels of the display. In this way, variations in the TFT threshold voltage are overcome, as all pixels are driven to voltages on either side of the linear operating region, even taking into consideration variations in the threshold voltages.

The drive level is thus preferably selected to have one of a plurality of values, and is selected such that any gate voltage for the drive transistor in the linear region corresponds to a voltage between steps of the voltage applied to the gate of the drive transistor. The drive level thus takes into account the range of threshold voltages and the linear regions of the drive transistors so that all pixels are driven either fully on or fully off.

Each pixel preferably further comprises an address transistor, connected between a power supply line and the gate of the drive transistor. This is used to charge the capacitor. Each pixel may further comprise means for disabling the driving of current by the drive transistor through the display element. During the capacitor charging step, the drive transistor can thus be turned off so that it does not influence the capacitor charging step.

The device is thus operable in two modes:

a first mode in which a pixel voltage is applied to the input to the pixel, the address transistor is turned on, the disabling means is turned on to turn off the display element and the storage capacitor is charged to a level derived from the drive voltage; and a second mode in which the address transistor is turned off, the disabling means is turned off and the stepped voltage waveform is applied to the input of the pixel.

These two modes define a programming stage when the input voltage is used to store a voltage on the capacitor, and then a subsequent drive stage.

The device may be operable in two sequential phases, one phase providing coarse resolution pulse width modulation and the other, shorter phase, providing fine resolution pulse width modulation. This enables more grey levels to be provided, by having a coarse resolution drive followed (or preceded) by a fine resolution drive.

The invention also provides a method of addressing an active matrix electroluminescent display device comprising an array of display pixels, each pixel comprising an electroluminescent (EL) display element, a drive transistor for driving a current through the display element, a drive voltage being provided to the gate of the drive transistor, and a storage capacitor for storing a drive level and connected between an input to the pixel and the gate of the drive transistor, the method comprising, for each pixel:

storing a pixel drive voltage on the storage capacitor;

providing a stepped voltage waveform to the input of the pixel, the stepped voltage waveform being voltage-shifted by the storage capacitor before application to the gate of the drive transistor, such that for a first set of the voltage steps applied to the gate of the drive transistor, the drive transistor is turned on, and for a second set of the voltage steps applied to the gate of the drive transistor, the drive transistor is turned off, the first and second sets being determined by the stored pixel drive level.

This method provides time ratio method using a stepped ramped voltage input to the pixel, which is effectively compared with the threshold voltage of the drive transistor. One of the steps provides a voltage which crosses the threshold voltage of the drive transistor, at which time the transistor is turned on or off, thereby providing control of the transistor duty cycle.

The first and second sets of voltage steps may be in either order. Thus, the stepped waveform may ramp up or down, and the point where the gate voltage crosses the transistor threshold voltage may represent the switching on or off of the drive transistor.

The height of the steps in the stepped voltage waveform is preferably greater than the voltage width of the linear operating region of the drive transistor, so that the voltages of the steps can be selected so that a step results in the linear operating region of the drive transistor being avoided. In particular, the height of the steps in the stepped voltage waveform can be greater than the voltage width of the overlaid linear operating region voltages of the drive transistors of all pixels of the display, so that the same stepped waveform can be used to avoid the linear operating region of all of the drive transistors.

Thus, the drive level can be selected to have one of a plurality of values, and selected such that any gate voltage for the drive transistor in the linear region corresponds to a voltage between steps of the voltage applied to the gate of the drive transistor. The device can be operable in two sequential phases, one phase providing coarse resolution pulse width modulation and the other, shorter phase, providing fine resolution pulse width modulation. This enables increased number of levels whilst retaining the required step height to avoid linear driving of the drive transistors.

The invention will now be described by way of example with reference to the accompanying drawings, in which.

Figure 1:
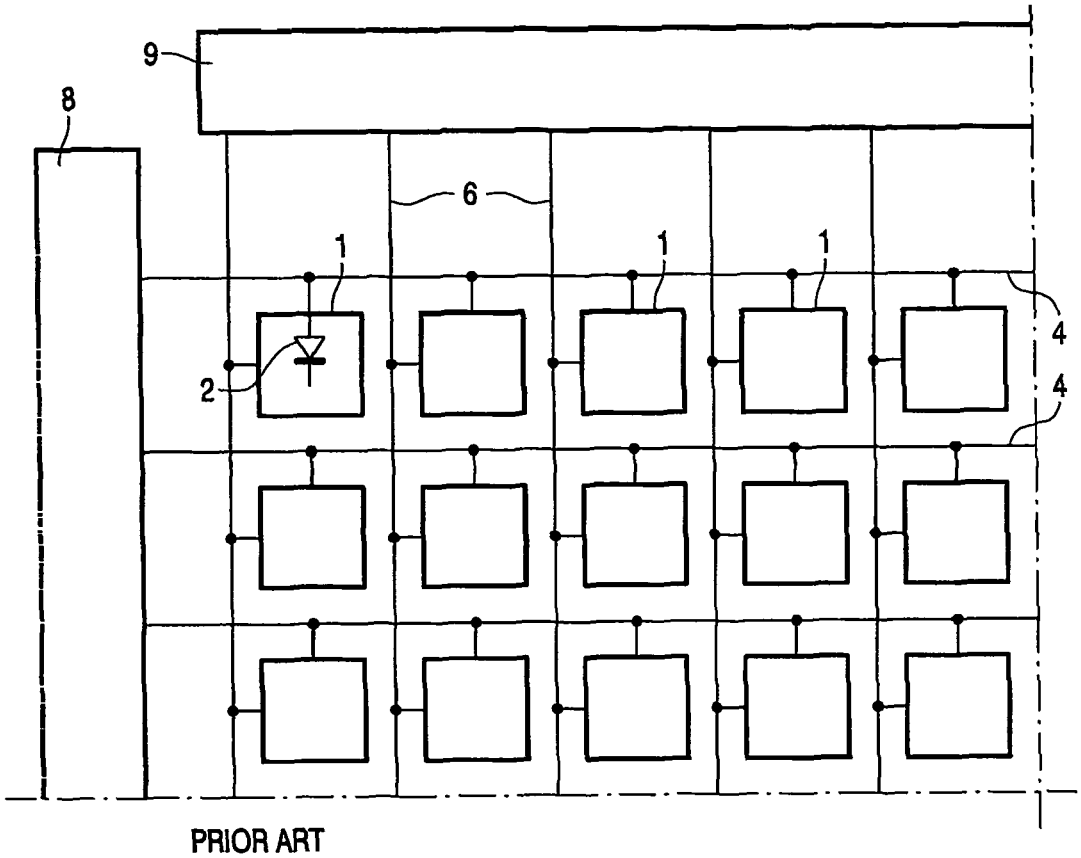
FIG. 1 shows a known EL display device.

The invention provides a pixel layout and drive method for implementing a time ratio drive scheme which uses a stepped reference voltage waveform, the step levels being selected so that the linear operating region of the drive transistor of the pixel is avoided.

The same reference numerals are used in different figures for the same components, and description of these components will not be repeated.

Figure 2:
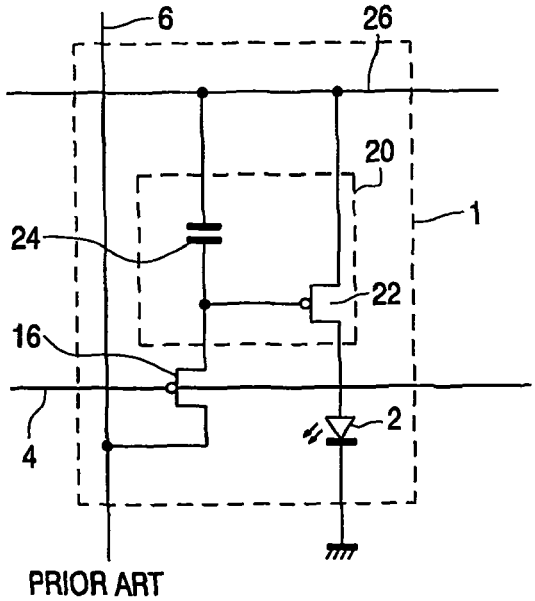
FIG. 2 is a schematic diagram of a known pixel circuit for current-addressing the EL display pixel using an input drive voltage.
Figure 3:
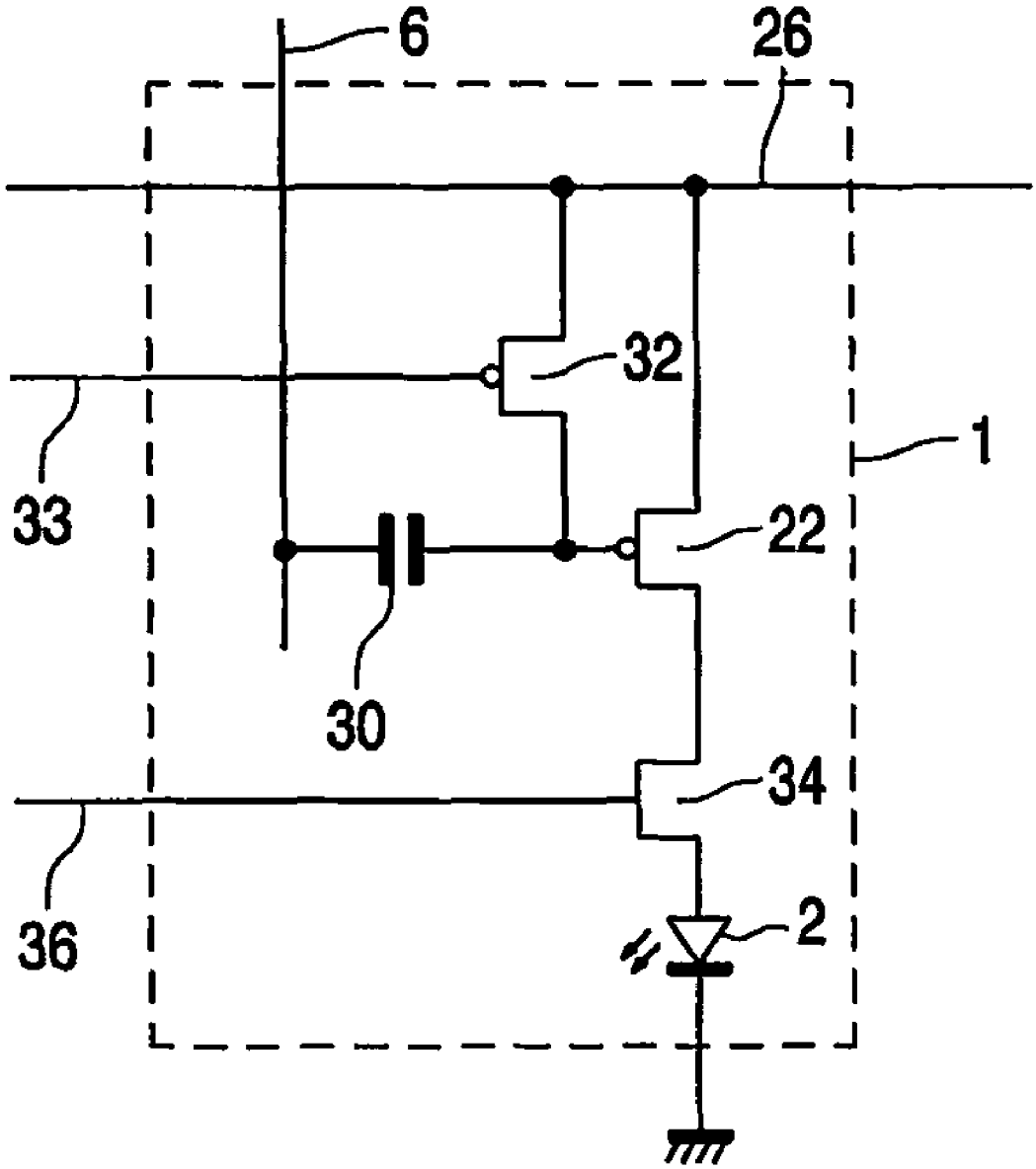
FIG. 3 shows a schematic diagram of a pixel layout for a display device of the invention.

FIG. 3 shows a first pixel arrangement in accordance with the invention. As in the conventional pixel of FIG. 2, the pixel is voltage-addressed, by applying a gate drive voltage to the drive transistor 22.

A storage capacitor 30 is provided between the gate of the drive transistor 22 and the column data line 6. This column data line 6 effectively defines the input to the pixel. The capacitor is provided for voltage-shifting the voltage on the column conductor, as will be explained further below.

The column driver circuitry (9 in FIG. 1) provides a stepped voltage waveform to the input of the pixel, and this stepped voltage waveform is voltage-shifted by the storage capacitor 30 before application to the gate of the drive transistor. The voltage shift introduced by the capacitor 30 determines when the voltage applied to the gate crosses the threshold voltage of the drive transistor 22.

In order to store the desired voltage on the capacitor 30, each pixel has an address transistor 32, connected between the power supply line 26 and the gate of the drive transistor 22. The address transistor 32 is controlled by an address line 33. This is used to charge the capacitor 30 during a pixel programming stage. During this programming stage, the column conductor 6 is held to a drive voltage (lower than the power supply line voltage) so as to charge the capacitor to the desired voltage.

During the programming stage, no current is driven through the display element 2, and the pixel circuit of FIG. 3 has an isolating transistor 34 which is turned off by enable line 36 during this stage. The ground connection of the cathode of the display element 2 may alternatively be provided through a switch, which can be switched to open circuit or to the power supply line voltage to turn off the drive transistor 22. This switch would then be common for all display elements. In such a case, the drain of the drive transistor 22 is connected directly to the anode of the display element 2.

As will be explained further below, the height of the steps in the stepped voltage waveform is greater than the range of gate-source voltages in the linear operating region of the drive transistor. This enables one of the steps to provide a transition between an on and off state of the drive transistor, without driving the transistor in the linear operating region. Indeed, the height of the steps in the stepped voltage waveform is greater than the range of gate-source voltages in the linear operating regions of the drive transistor of all pixels of the display. In this way, the effect of variations in the TFT threshold voltages are eliminated, as all pixels are driven to voltages on either side of the linear operating region.

Figure 4:
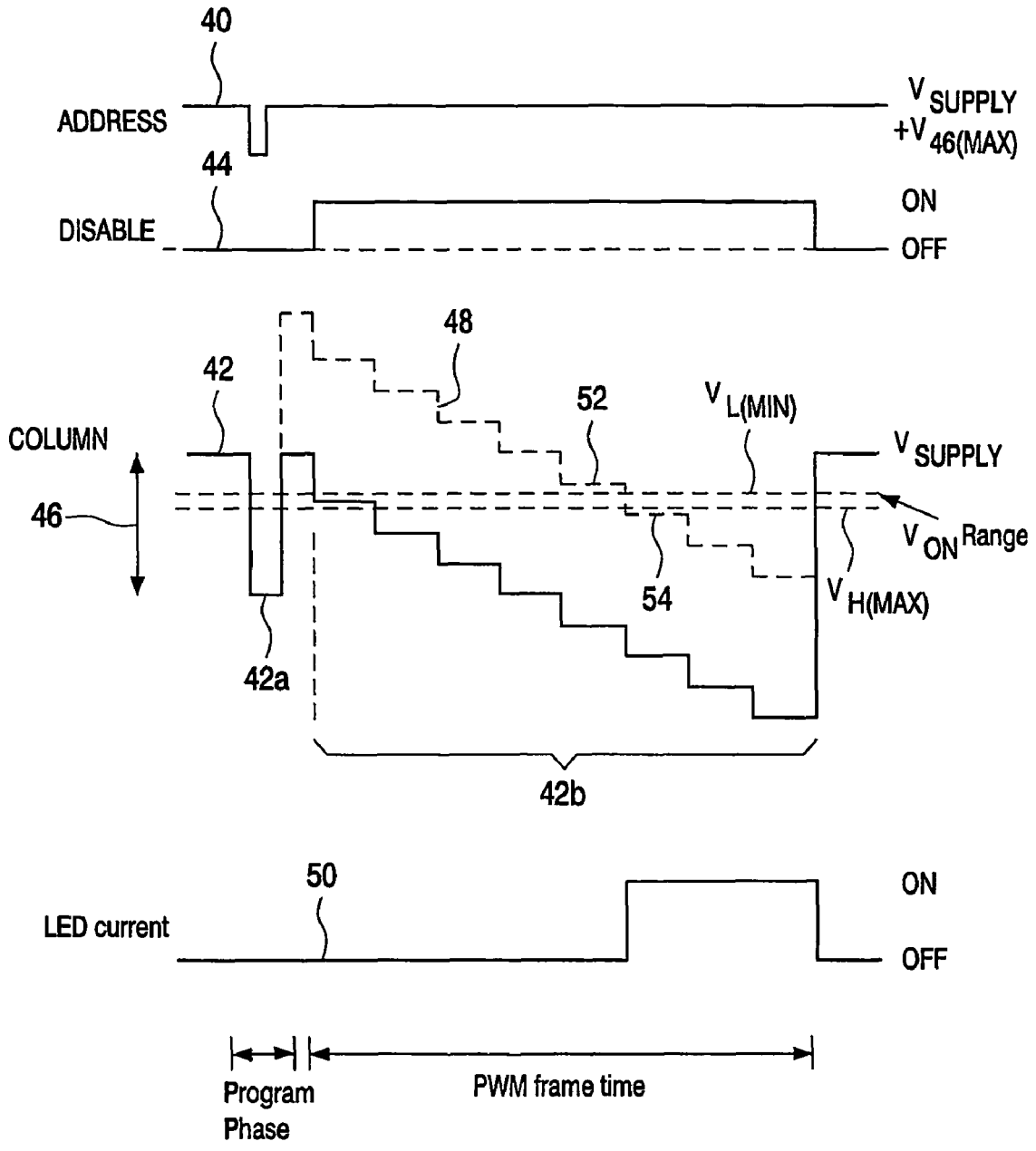
FIG. 4 is a timing diagram for explaining the operation of the circuit of FIG. 3.

FIG. 4 is used to explain in greater detail the operation of the circuit.

The pixel drive scheme starts with the programming phase. Plot 40 shows the voltage on the address line 33. During the programming phase, the address line voltage is switched low in order to turn on the PMOS address transistor 32. The capacitor 30 is then charged through the address transistor 32 to a voltage dependent on the voltage provided on the column 6. Plot 42 shows the voltage provided on the column, and the part 42*a* of the plot is the pixel drive level having a step height shown as 46, which determines the voltage stored across the capacitor 30. During the programming phase, the isolating transistor is turned off, and plot 44 shows the voltage on the enable line 36. The low voltage during the programming phase turns off the NMOS isolating transistor 34.

At the end of the programming phase, the address line voltage 40 goes high, to turn off the address transistor 32, and the voltage 46 is stored on the capacitor 30.

The high level of the address voltage needs to be higher than the supply voltage, $V_{SUPPLY}$, when driving the display element, in order to ensure the address transistor 32 remains off (in the reverse as well as forward direction) regardless of the voltage on the gate of the drive transistor 22. As shown in FIG. 4, the high address line voltage can be set at the supply voltage $V_{SUPPLY}$ plus the maximum shift voltage 46.

The stepped ramped part 42*b* of the column voltage 42 is then applied to the column 6, and the effect of the capacitor is to shift this to the plot 48, which is the voltage applied to the gate of the drive transistor 22.

The voltage 48 is initially higher than the supply line voltage so that the PMOS drive transistor 22 is turned off. Only when the voltage steps below the supply line voltage by an amount equal to the threshold voltage of the drive transistor 22 does the transistor turn on, as represented by plot 50 which indicates when a current is driven through the display element 2.

It is apparent that the level of the voltage shift 46 determines the duty cycle of the LED current profile, and this voltage shift thus implements a pulse width modulation drive scheme.

The threshold voltages for different transistors in the array will be slightly different. Furthermore, for gate-source voltages close to the threshold voltage, the drive transistors operate in their linear operating region. This is the region between the fully on and fully off drive conditions of the drive transistor 22.

Figure 5:
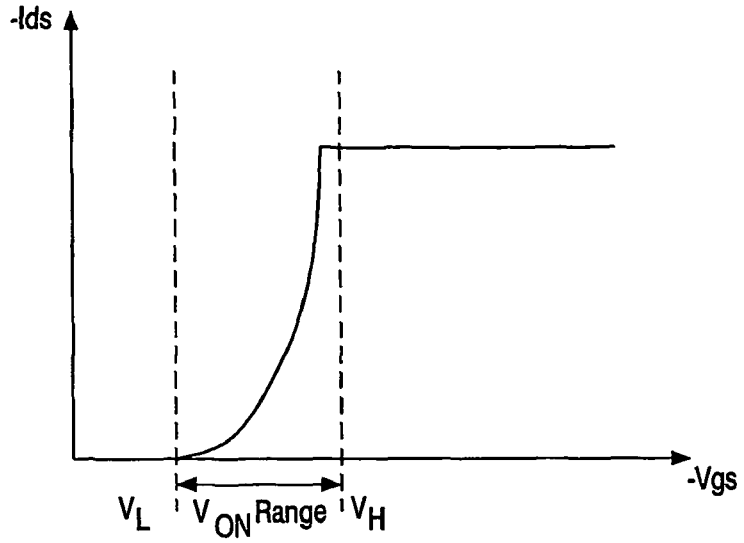
FIG. 5 shows the turn-on characteristics of the drive transistor of the pixel circuit of FIG. 3 and is used to explain how the voltage waveforms are selected.

FIG. 5 shows schematically the turn on characteristics of the drive transistor when driving the display element load, and plots the gate-source voltage versus the source drain current. Below a voltage $V_L$, the transistor is turned OFF. This may for example be the voltage at which the current flowing is 1% of the peak current. Above a voltage $V_H$, the transistor is turned ON. This may for example be the voltage at which the current flowing is constant, and thereby limited by the load being driven. For example, this voltage may be defined as the voltage above which the current varies by less than 5% (up to the breakdown voltage). The voltage range between $V_L$ and $V_H$ is the linear operating region of the transistor. Other definitions may be used, but the linear operating region is essentially the operating region where the current increases substantially in response to an increase in gate source voltage, whereas when the transistor is turned fully on or off the current is substantially constant.

The exact values of $V_L$ and $V_H$ will vary for different transistors across the substrate. However, this extent of this variation is predictable or measurable, so that the range of voltage values is known. Furthermore, the range of variation is relatively small, for example 10-15%.

Referring back to FIG. 4, the steps of the waveform 42 are selected so that the step height is greater than the voltage width of the linear operating region of the drive transistor 22, namely the voltage width between $V_L$ and $V_H$. This is ensured for all pixels of the display. As shown in FIG. 4, the range of voltages "$V_{ON}$ Range" between the minimum value of $V_L$ and the maximum value of $V_H$ are arranged to lie between steps 52 and 54 of the plot 48.

This is achieved by selecting a step height greater than the range between $V_{L(MIN)}$ and $V_{H(MAX)}$ but also by selecting the voltage level 46 to have a number of discrete possible values so that the range $V_{ON}$ Range is always between voltage step transitions.

The required height of the step is 1V to 1.5V for a low-threshold-voltage TFT, although the values will depend on the particular transistor technology used, and may be significantly higher. In the example shown in FIG. 4, 8 steps are provided, which can be easily achieved below the gate breakdown voltage of around 16V. Thus, 8 possible PWM levels can be obtained.

Figure 6:
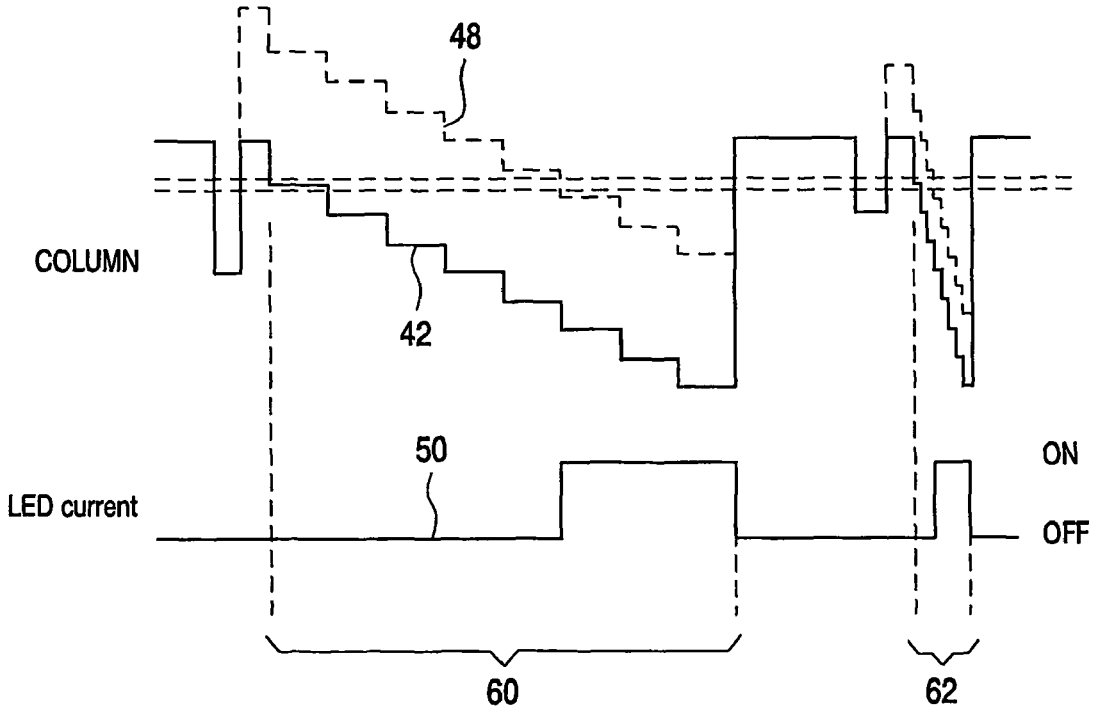
FIG. 6 is a timing diagram for explaining a modified operation of the circuit of FIG. 3.

FIG. 6 shows a scheme for providing more grey levels, but shows only the plots 42, 48 and 50 of FIG. 4. The device is operable in two sequential phases. The order of the two phases is not important, but in FIG. 6, the first phase 60 provides a most significant PWM output, namely lower resolution (longer) PWM steps, and the second phase 62 provides higher resolution (shorter) PWM steps. This enables more grey levels to be provided, by having a coarse resolution drive followed by a fine resolution drive. In each phase, the linear operating voltage ranges for the drive transistors are arranged to correspond to the transition between steps, as shown.

In order to address an array of display pixels, all capacitors in the array can initially be charged to the desired values. Once the pixel capacitors have been charged, the same column drive signal (the un-shifted stepped waveform) can be used to drive all pixels in a column simultaneously. Furthermore, all columns can also be driven simultaneously.

In FIG. 6, the total frame period may be approximately 17 ms, derived from a 60 Hz frame rate. If 50% of the frame period is available for emission, and the remainder for the programming sequences and for a guard time between sequences, there is approximately 4 ms available for each program cycle. The longer display sequence 60 will last around 7 ms and the shorter display sequence 62 will last around 1 ms. The shortest step duration, for the 8 steps in the shorter display sequence, will therefore last around 0.1 ms.

Figure 7:
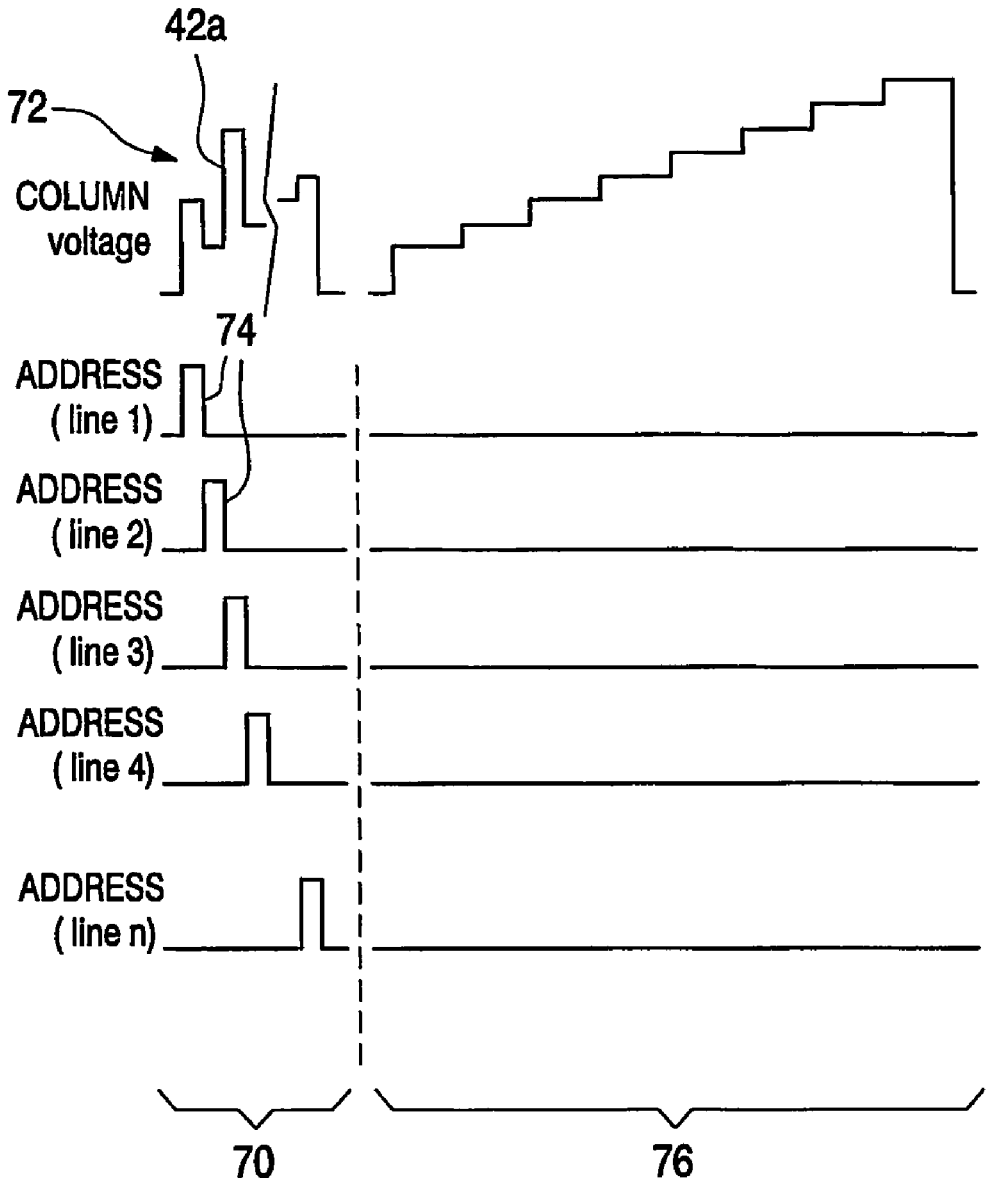
FIG. 7 is a timing diagram to show how the address operation of the invention is applied to an array of pixels.

FIG. 7 is used to explain one possible timing scheme for addressing an array of pixels. During a programming phase 70, a sequence of the pulses 42*a* of FIG. 4 is applied to each column conductor simultaneously. FIG. 7 shows at 72 the Column voltage waveform for one column conductor. The rows are addressed in turn by the address pulses 74, and these address pulses 74 enable a generated level 42*a* to be used to charge the storage capacitor of an individual pixel.

At the end of the programming phase 70, all pixels of the array have a selected voltage stored on the capacitor. The drive phase 76 involves applying the same column waveform (the un-shifted stepped ramp) to all columns. All pixels are thus driven simultaneously, with an individual column conductor waveform being used for the addressing of all pixels in a column, and with column conductor waveforms being applied to all columns at the same time.

It is possible to multiplex the signals applied to the columns, so that groups of columns can be programmed in turn, rather than all simultaneously. This is well known technique, and reduces the number of separate signal generation circuits that are required, as the circuitry for generating the programming sequence can then be shared between columns. As the driving of all pixels involves applying the same signal to all columns, there is no need to consider any multiplexing arrangement for this phase 76.

FIG. 7 only shows one address sequence (and also shows that the column signal can ramp up instead of down), but it will be understood that the timing explained with reference to FIG. 7 can be extended to provide the two-sequence operation of FIG. 6.

The column driver has not been described in detail in the above description, but the conventional driver 9 of FIG. 1 can be modified in routine manner to enable generation of the required stepped waveform and the initial pixel programming voltage profile. The required circuitry of the column driver will not be discussed in detail.

In the example above, only one specific pixel layout has been described. It will be understood that different combinations of NMOS and PMOS transistors may be used, and that the pixel circuit may have additional circuit elements to those described for implementing additional functionality, such as in-pixel memory.

The ramped step voltage waveform has been shown with uniform step height and width, but the step height and/or width could be non-uniform without departing from the invention, provided the minimum step height exceeds the determined range of voltages.

Various other modifications will be apparent to those skilled in the art.

The invention claimed is:

1. An active matrix electroluminescent display device comprising an array of display pixels, each pixel comprising:

an electroluminescent display element;

a drive transistor for driving a current through the display element, a drive voltage being provided to the gate of the drive transistor;

and a storage capacitor for storing a pixel voltage, said storage capacitor being connected between an input to the pixel and the gate of the drive transistor, wherein a driver circuitry provides a stepped voltage waveform to the input of the pixel, the stepped voltage waveform being voltage-shifted by the storage capacitor before application to the gate of the drive transistor, and wherein a height of steps in the stepped voltage waveform is greater than a voltage width of a linear operating region of the drive transistor so that the linear operating region of the drive transistor is avoided, the pixel voltage being selected so that a voltage range of the linear operating region corresponds to voltage levels between a transition of two steps of the stepped voltage waveform.

2. The device as claimed in claim 1, wherein the height of the steps in the stepped voltage waveform is sufficient to include the linear operating region voltages of the drive transistors of all pixels of the display.

3. The device as claimed in claim 1, wherein each pixel further comprises an address transistor, connected between a power supply line and the gate of the drive transistor.

4. The device as claimed in claim 3, wherein each pixel further comprises means for disabling the driving of current by the drive transistor through the display element.

5. The device as claimed in claim 4, wherein the means for disabling comprises an isolating transistor in series with the drive transistor and the display element.

6. The device as claimed in claim 3, wherein the device further comprises disabling means comprising a switch for switching the voltage on one terminal of the display elements of the array of pixels.

7. The device as claimed in claim 1, wherein the device is operable in at least two sequential phases, one phase providing coarse resolution pulse width modulation and the other, shorter phase, providing fine resolution pulse width modulation.

8. The device of claim 1, further comprising an address transistor having a gate terminal for receiving an address signal to turn the address transistor on and off, and source and drain terminals that are directly connected between the power supply line and the gate of the drive transistor.

9. An active matrix electroluminescent display device comprising an array of display pixels, each pixel comprising:

an electroluminescent display element;

a drive transistor for driving a current through the display element, a drive voltage waveform being provided to the gate of the drive transistor;

an address transistor, connected between a power supply line and the gate of the drive transistor;

means for disabling the driving of the current by the drive transistor through the display element; and a storage capacitor for storing a pixel voltage, said storage capacitor being connected between an input to the pixel and the gate of the drive transistor, wherein a driver circuitry provides a stepped voltage waveform to the input of the pixel, the stepped voltage waveform being voltage-shifted by the storage capacitor before application to the gate of the drive transistor to form the drive voltage waveform, and wherein a height of steps in the stepped voltage waveform is greater than a voltage width of a linear operating region of the drive transistor, the pixel voltage being selected so that a voltage range of the linear operating region corresponds to voltage levels between a transition of two steps of the stepped voltage waveform, and wherein the device is operable in two modes:

a first mode in which the pixel voltage is applied to the input of the pixel, the address transistor is turned on, the disabling means is turned on to turn off the display element and the storage capacitor is charged to the pixel voltage; and a second mode in which the address transistor is turned off, the disabling means is turned off and the stepped voltage waveform is applied to the input of the pixel.

10. The device of claim 9, wherein the address transistor has a gate terminal for receiving an address signal to turn the address transistor on and off, and source and drain terminals that are directly connected between the power supply line and the gate of the drive transistor.

11. A method of addressing an active matrix electroluminescent display device comprising an array of display pixels, each pixel comprising an electroluminescent display element, a drive transistor for driving a current through the display element, and a storage capacitor connected between an input to the pixel and a gate of the drive transistor, the method comprising the acts of:

storing a pixel voltage on the storage capacitor;

providing a stepped voltage waveform to the input of the pixel, the stepped voltage waveform being voltage-shifted by the pixel voltage stored on the storage capacitor before application to the gate of the drive transistor, such that for a first set of voltage steps of the stepped voltage waveform applied to the gate of the drive transistor, the drive transistor is turned on, and for a second set of the voltage steps applied to the gate of the drive transistor, the drive transistor is turned off, the first and second sets being determined by the stored pixel voltage; and avoiding a linear operating region of the drive transistor by having a height of the voltage steps of the first set and the second set being greater than a voltage width of a linear operating region of the drive transistor, the pixel voltage being selected so that a voltage range of the linear operating region corresponds to voltage levels between a transition of two steps of the stepped voltage waveform.

12. The method as claimed in claim 11, wherein the height of the steps in the stepped voltage waveform is greater than the voltage width of the overlaid linear operating region voltages of the drive transistors of all pixels of the display.

13. The method as claimed in claim 11, wherein the act of storing a pixel voltage on the storage capacitor comprises turning on an address transistor connected between a power supply line and the gate of the drive transistor and charging the storage capacitor using the address transistor.

14. The method as claimed in claim 11, wherein the device is operable in at least two sequential phases, one phase providing coarse resolution pulse width modulation and the other, shorter phase, providing fine resolution pulse width modulation.

15. The method as claimed in claim 14, wherein the stepped voltage waveform to the input of the pixel has the same voltage levels in the two phases, and the shorter phase has shorter step durations.

16. The method of claim 11, wherein the pixel voltage stored on the storage capacitor determines a duty cycle of a current profile for operating the electroluminescent display element.

17. A method of addressing an active matrix electroluminescent display device comprising an array of display pixels, each pixel comprising an electroluminescent display element, a drive transistor for driving a current through the display element, and a storage capacitor connected between an input to the pixel and the gate of the drive transistor, the method comprising the acts of:

storing a pixel voltage on the storage capacitor;

providing a stepped voltage waveform to the input of the pixel, the stepped voltage waveform being voltage-shifted by the pixel voltage stored on the storage capacitor before application to a gate of the drive transistor, such that for a first set of the voltage steps applied to the gate of the drive transistor, the drive transistor is turned on, and for a second set of the voltage steps applied to the gate of the drive transistor, the drive transistor is turned off, the first and second sets being determined by the stored pixel voltage;

disabling the driving of the current by the drive transistor through the display element during the storing of the pixel voltage on the storage capacitor;

in a first mode in which the pixel voltage is applied to the input to the pixel, turning on the address transistor, turning off the display element, and charging the storage capacitor to a level derived from the drive voltage; and in a second mode in which the address transistor is turned off, applying the stepped voltage waveform to the input of the pixel;

wherein a height of steps in the stepped voltage waveform is greater than a voltage width of a linear operating region of the drive transistor so that the linear operating region of the drive transistor is avoided, and wherein the pixel voltage is selected so that a voltage range of the linear operating region corresponds to voltage levels between a transition of two steps of the stepped voltage waveform.

18. The method of claim 17, wherein the pixel voltage stored on the storage capacitor determines a duty cycle of a current profile for operating the electroluminescent display element.

* * * * *